United States Patent [19]

Babik

[11] 4,215,443

[45] Aug. 5, 1980

[54] TOILET ANTI-SPLASH AND SILENCER DEVICE

[76] Inventor: Peter P. Babik, 4142 Reicosky La. NW., Canton, Ohio 44718

[21] Appl. No.: 23,642

[22] Filed: Mar. 26, 1979

Related U.S. Application Data

[63] Continuation-in-part of Ser. No. 895,750, Apr. 13, 1978, abandoned.

[51] Int. Cl.[2] ..... E03D 11/00; A47K 17/00

[52] U.S. Cl. ..... 4/300.3; 4/238; 4/DIG. 5

[58] Field of Search ..... 4/1, 134, DIG. 5, 138, 4/144, 234, 238, 237, 239–241, 139, 231, 309; D23/53; 248/240, 240.1; 46/47

[56] References Cited

U.S. PATENT DOCUMENTS

| | | | |
|---|---|---|---|
| 1,063,247 | 6/1913 | Ebert | 4/238 |
| 1,857,328 | 5/1932 | Piper | 4/DIG. 5 |
| 1,950,016 | 3/1934 | Zuckerman | 4/239 |
| 2,931,047 | 4/1960 | Stebbins | 4/1 |
| 3,212,104 | 10/1965 | Stevens | 4/1 |
| 3,350,722 | 11/1967 | Moreschine | 4/1 |
| 3,859,670 | 1/1975 | Crump, Jr. | 4/1 |
| 4,062,070 | 12/1977 | Prince | 4/1 |

*Primary Examiner*—Stuart S. Levy
*Attorney, Agent, or Firm*—Paul E. Milliken

[57] ABSTRACT

A toilet anti-splash and silencer device for mounting on a toilet at the rear of the bowl. A baffle member for dispersing urine quietly into the water of the toilet bowl is pivotally suspended within the bowl on an arm member and is moved to an extended operative position when the toilet seat is raised and is moved to a retracted inoperative position when the seat is lowered. The seat contacts a portion of the silencer device so that movement of the seat moves the arm and baffle member to the desired position. The device may be attached to the center of the seat hinge pin or in toilets of the type where the center of the hinge pin is covered by the seat, a special spring attachment which fastens to the seat hinge brackets may be used. The device may be made of molded plastic, metal or other suitable materials suitably treated to prevent rust and corrosion. Another embodiment of the invention permits it to be fastened beneath the hinge brackets of the toilet, thereby making it useable either on a seat with an exposed hinge pin or the type where the hinge pin is covered by the seat.

6 Claims, 11 Drawing Figures

TOILET ANTI-SPLASH AND SILENCER DEVICE

This is a continuation-in-part of application Ser. No. 895,750 filed Apr. 13, 1978, now abandoned.

This invention relates to an anti-splash and silencer device for mounting on the rear of a toilet bowl. A baffle member for quietly dispersing urine into the bowl is pivotally suspended within the bowl so it can be moved from an inoperative position when the seat is down to an operative position when the seat is raised.

PRIOR ART

The closest prior art known to applicant are U.S. Pat. Nos. 538,168, 2,839,764, 2,931,047, 3,350,722, 3,212,104, 3,931,649, 4,062,070 and Netherland Pat. No. 64,967.

OBJECTS OF THE INVENTION

It is a primary object of this invention to provide a device which will reduce the noise and splash of a urine stream entering a toilet bowl.

Another object of this invention is to provide an anti-splash and silencer device which can be easily attached to or removed from a conventional flush toilet.

A still further object of the invention is to provide an anti-splash and silencer device which is automatically moved from an operative position when the seat is raised, to an inoperative position when the seat is lowered.

These and other objects of the invention will become more fully apparent as the description proceeds in the following specification and the attached drawings.

STATEMENT OF THE INVENTION

This invention is a toilet anti-splash and silencer device for use on a flush toilet including an assembly of a bowl with an upper rim and a seat hingedly mounted on seat hinge brackets attached adjacent the rim at the rear of the bowl comprising: means attaching the silencer device to the bowl and seat assembly at the seat hinge brackets for pivotal movement about an axis adjacent the upper rim at the rear of the bowl; and arm member extending from the attaching means into the interior of the bowl; a perforate baffle means attached to the end of the arm member which is extended into the bowl; and a seat contacting means attached to the arm member at the end opposite the baffle means; said seat contacting means being adapted to cooperate with the seat in such manner that when the seat is lowered, the arm and baffle are moved to a retracted position at the rear of the bowl and when the set is raised the arm and baffle are moved to an extended position toward the center of the bowl.

DESCRIPTION OF THE PREFERRED EMBODIMENTS

Figure 1:
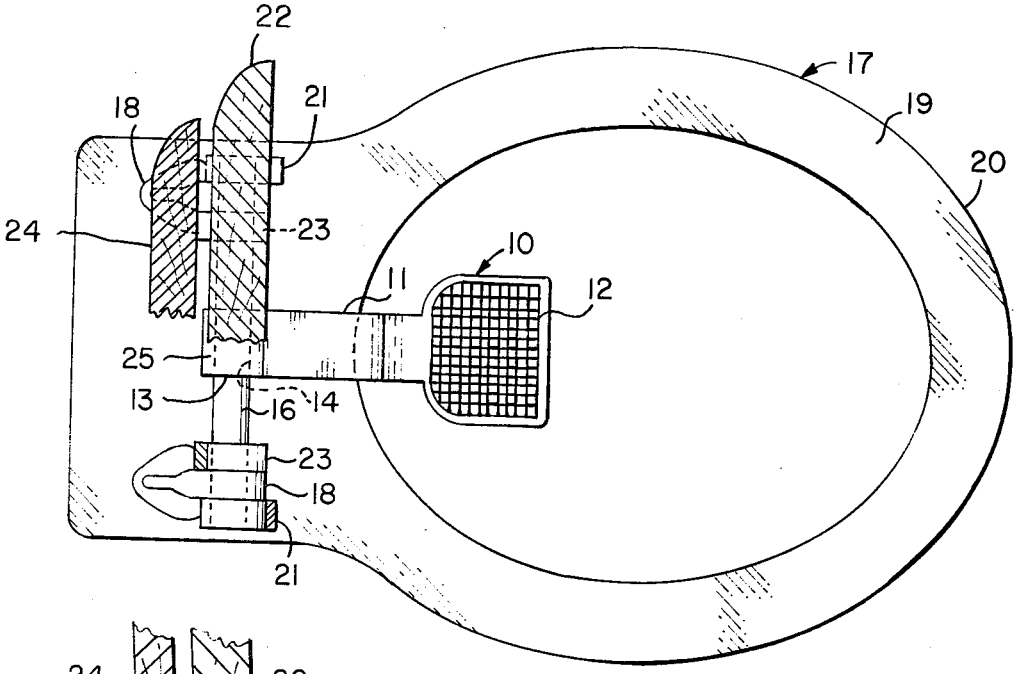
FIG. 1 is a top plan view of a toilet using one embodiment of the invention with portions of the seat and lid broken away to better illustrate the invention.
Figure 2:
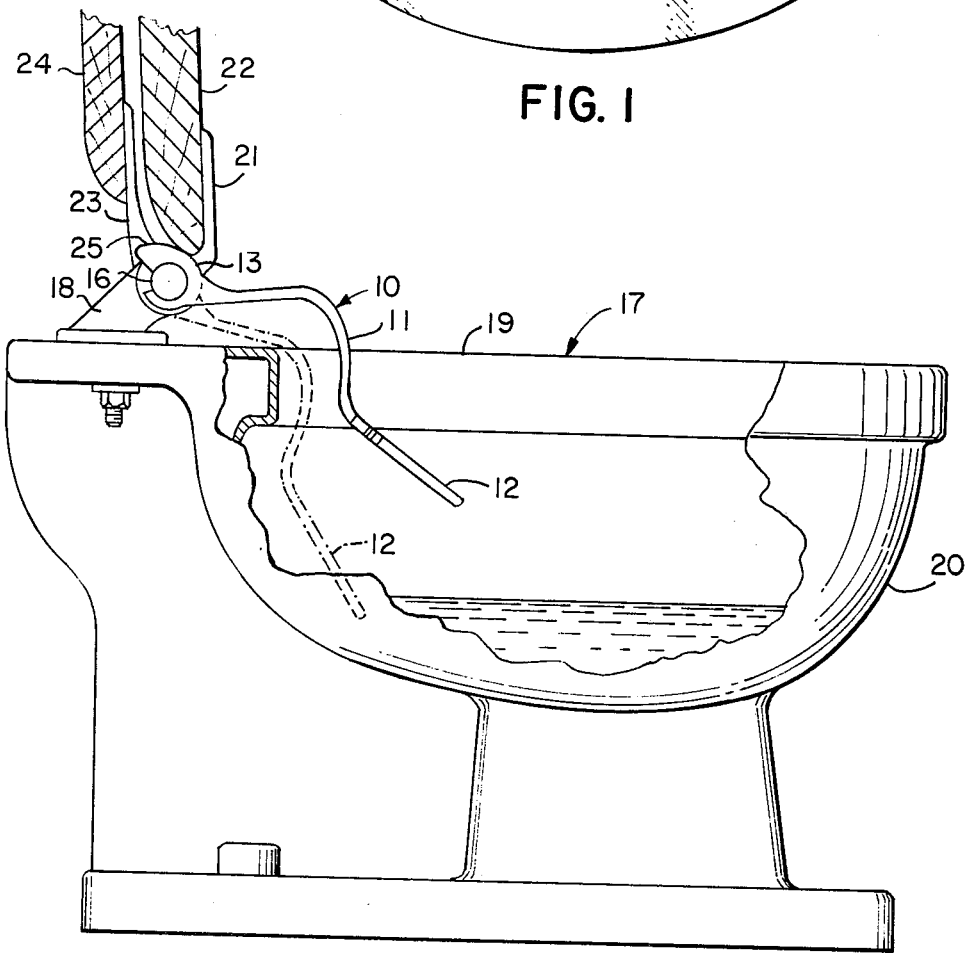
FIG. 2 is a side view of a toilet with portions broken away to illustrate the same embodiment of the invention as that shown in FIG. 1.
Figure 3:
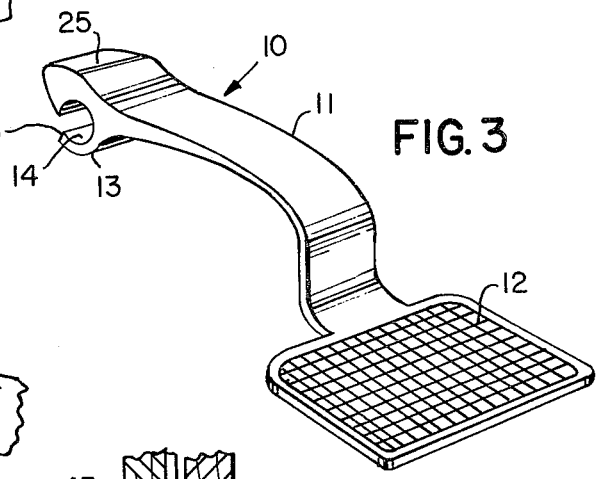
FIG. 3 is a perspective view of the same embodiment as that shown in FIGS. 1 and 2 but with the device removed from the toilet.

Referring to the drawings and in particular FIGS. 1 through 3, the anti-splash and silencer device is illustrated as a whole by the numeral 10 as shown in FIG. 3 and having a curved arm member 11 with a baffle screen member 12 on one end thereof and an axially split resilient tubular attachment member 13 on the opposite end thereof. The member 13 is formed as an integral part of the arm 11 and is positioned with respect to the end of the arm 11 in such manner that an axially extending hole 14 in the member 13 extends transversely of the arm 11. The member 13 has an axially extending split 15 along the entire length of the member 13 and facing in the opposite direct to the arm 11 so that the member 13 can be snapped onto a hinge pin 16 of a toilet 17 as shown in FIGS. 1 and 2. The pin 16 is supported on opposite ends by a pair of hinge brackets 18 which are bolted to the top of the rim 19 of the toilet bowl 20 at the rear of the toilet 17.

Also attached to the hinge pin 16 are a pair of seat hinges 21 positioned axially outwardly of the brackets 18 and supporting a seat 22. Positioned on the axially inward side of the brackets 18 are a pair of lid hinges 23 pivotally mounted on the hinge pin 16 and supporting a lid 24.

The tubular member 13 has an axially extending rib 25 projecting radially outwardly from the member 13 to contact the rear edge of the seat 22 when the device 10 is snapped in position of the pin 16. The seat edge and the rib 25 co-operate in a cam-action when the seat 22 is raised or lowered. When the seat 22 is raised as shown in FIG. 2, the seat edge bears against the rib 25 and causes the silencer device to pivot about the pin 16 and moved the baffle 12 into an extended or operative position within the bowl 20 so that a stream of urine directed at the baffle 12 is dispersed quietly and with a minimum amount of splash into the water in the bottom of the bowl 20. If the seal 22 is lowered to rest on the rim 19, then the silencer device 10 is swung automatically into a retracted or inoperative position at the rear of the bowl. In the retracted position as shown by the chain dotted lines in FIG. 2, the flush water of the toilet 17 will wash across the baffle 12 and tend to clean it. It should be understood that certain mesh sizes in the screen of baffle 12 will function more effectively than others and in some instances it may be desirable to use two or more layers of screen to further disperse the urine stream. When molding the device 10 as a single integral piece, it may be necessary provide a certain screen configuration which may be easily molded. If the screen is inserted as a separate part of the device 10 then more varieties of screen design can be used. While the preferred embodiment is shown as being made of molded plastic it can be made of metal or other suitable materials if treated to resist rust and corrosion.

Figure 4:
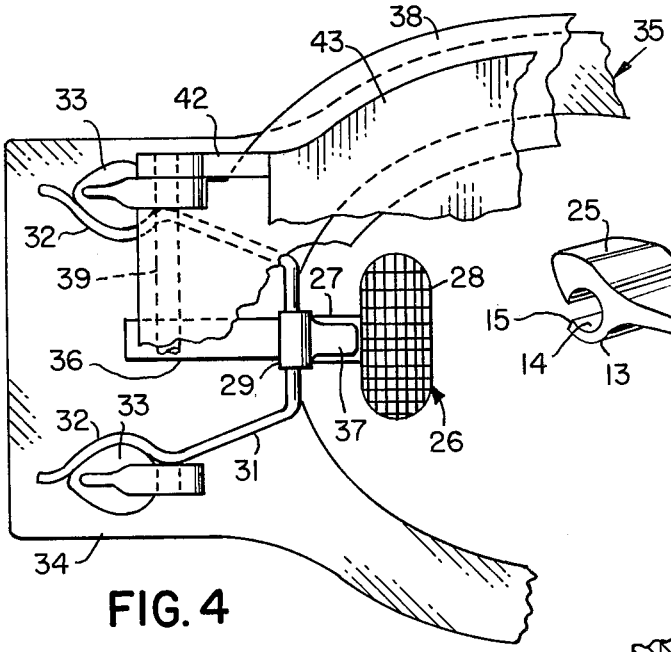
FIG. 4 is a fragmentary top plan view of a toilet showing another embodiment of the invention.
Figure 5:
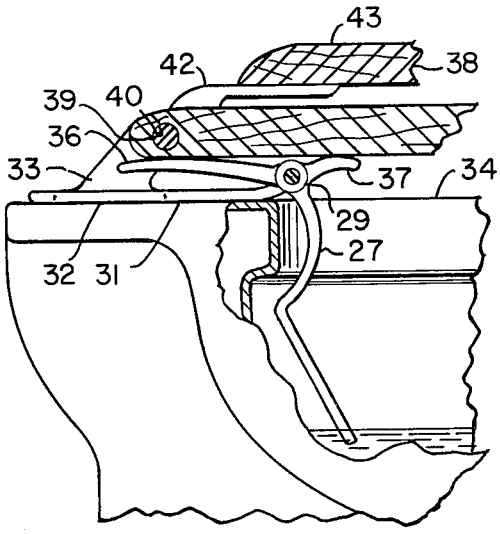
FIG. 5 is a fragmentary side elevational view of a toilet showing the same embodiment of the invention as that shown in FIG. 4 with the device in the retracted position.
Figure 6:
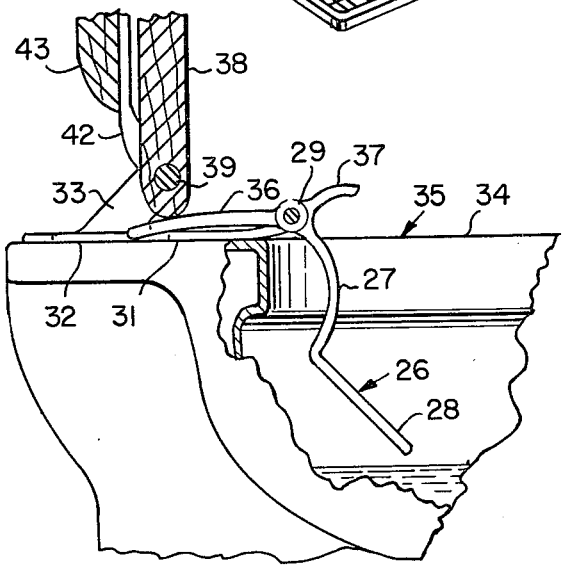
FIG. 6 is a fragmentary side elevational view of a toilet showing the same embodiment shown in FIGS. 4 and 5 but with the device in the extended position.
Figure 7:
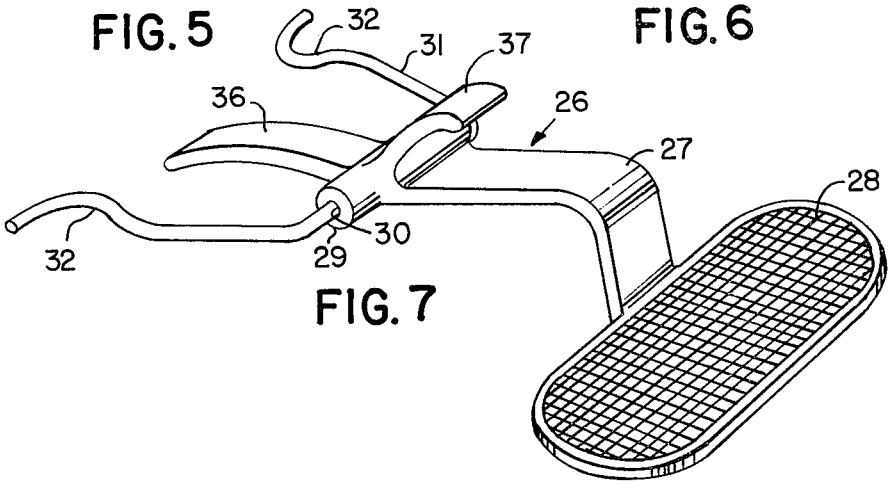
FIG. 7 is a perspective view of the embodiment of the invention shown in FIGS. 4 through 6 but with the device removed from the toilet.

FIGS. 4 through 7 illustrate another embodiment of the invention which is designed to fit on a toilet in which the hinge pin is not exposed at its axial center but passes through the seat so that the embodiment shown in FIGS. 1 through 3 will not fit this type of hinge arrangemnt. The alternative silencer device is shown as a whole by the numeral 26 and is best illustrated in FIG. 7. The device 26 has an arm member 27 similar to arm 11 and a baffle 28 similar to the baffle 12 in the first described embodiment of FIGS. 1 through 3. A tubular member 29 having an axially extending hole 30 is attached to the end of the arm 27 opposite from the baffle 28. Passing through the hole 30 is a spring clip 31 which has two curved end portions 32 which engage a pair of seat hinge brackets 33 on the bowl 34 of the toilet 35 as best illustrated in FIGS. 4 and 5. A seat contacting lever 36 extends rearwardly from the tubular member 30 and a second seat contacting lever 37 extends forwardly from the tubular member 30.

A seat 38 is hinged to the toilet 35 with a hinge pin 39 passing through a hole 40 in the rear edge of the seat 38. The hinge pin 39 is supported on each end by a pair of hinge brackets 33 which are bolted to the bowl 34. A pair of lid hinges 42 supporting a lid 43 are pivotally mounted on the hinge pin 39 axially outwardly of the brackets 33.

In FIGS. 4 and 5 it may be seen that when the seat 38 is lowered, the bottom of the seat contacts the lever 37 and causes the silencer device 26 to swing the arm 27 and baffle 28 into the retracted or inoperative position at the rear of the toilet bowl 34. On the other hand when the seat 38 is raised as shown in FIG. 6, then the rear edge of the seat 38 contacts the lever 36 and forces it down thereby causing the arm 27 and baffle 28 to swing into the extended or operative position in the bowl 34.

Figure 8:
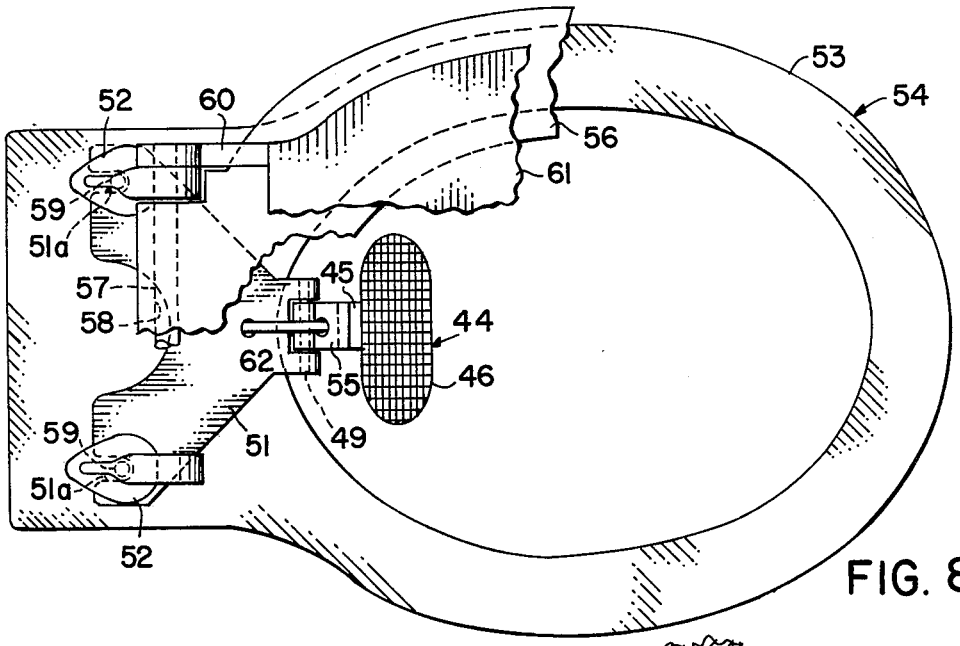
FIG. 8 is a top plan view of a toilet showing a third embodiment of the invention.
Figure 9:
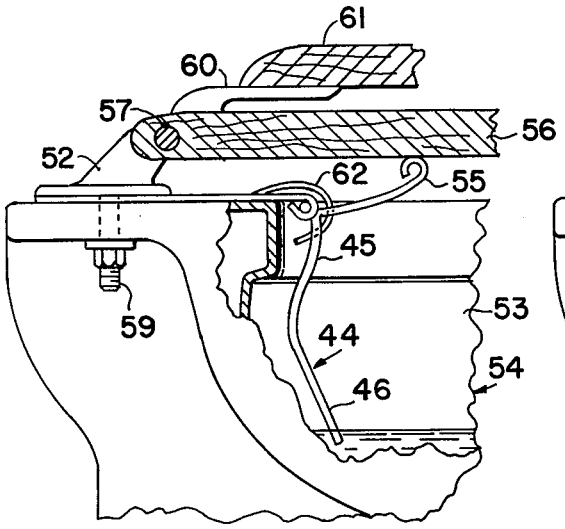
FIG. 9 is a fragmentary side elevational view of a toilet showing the same embodiment of the invention as that shown in FIG. 8 with the device in the retracted position.
Figure 10:
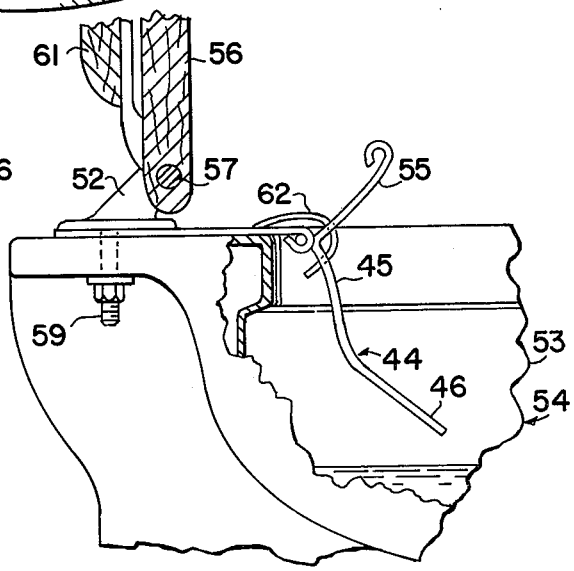
FIG. 10 is a fragmentary side elevational view of a toilet showing the same embodiment shown in FIGS. 8 and 9 but with the device in the extended position.
Figure 11:
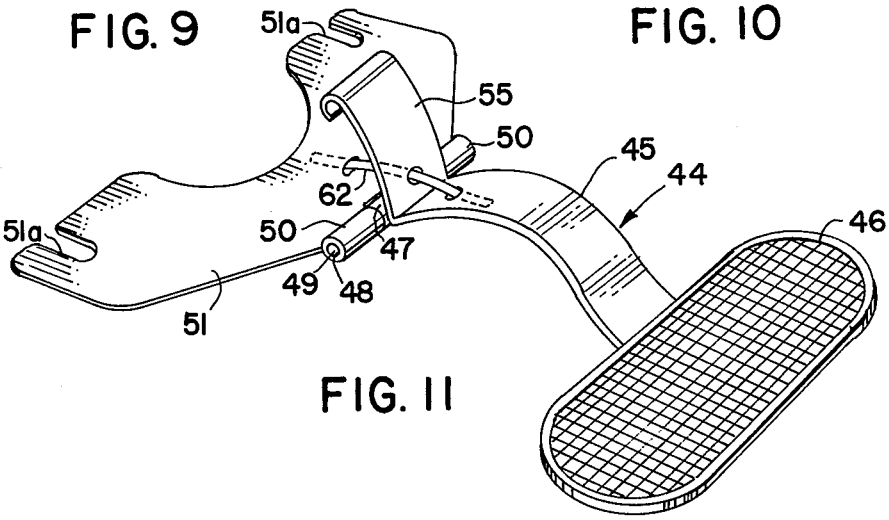
FIG. 11 is a perspective view of the embodiment of the invention shown in FIGS. 8 through 10 but with the device removed from the toilet.

FIGS. 8 through 11 illustrate another embodiment of the invention which is designed to fit either on a toilet of the type shown in FIGS. 1 through 3 or the type shown in FIGS. 4 through 7. This third alternative silencer device is shown as a whole by the numeral 44 and is best illustrated in FIG. 11. The device 44 has an arm member 45 similar to arm 11 and a baffle 46 similar to the baffle 12 in the first described embodiment of FIGS. 1 through 3. A tubular member 47 having an axially extending hole 48 is attached to the end of the arm 45 opposite from the baffle 46. Passing through the hole 48 is a hinge pin 49 which also extends through spaced apart tubular hinge portions 50 which are attached to a yoke shaped mounting member 51. The member 51 is in the form of a thin flat plate to permit it to be clamped under a pair of seat hinge brackets 52 on the bowl 53 of the toilet 54 as best illustrated in FIGS. 8 and 9. A seat contacting lever 55 extends upwardly from the tubular member 47.

A seat 56 is hinged to the toilet 54 with a hinge pin 57 passing through a hole 58 in the rear edge of the seat 56. The hinge pin 57 is supported on each end by the pair of hinge brackets 52 which are bolted to the bowl 53 by a pair of bolts 59. The mounting member 51 is provided with two slots **51*a* to receive the bolts 59. A pair of lid hinges 60 supporting a lid 61 are pivotally mounted on the seat hinge pin 57 axially outwardly of the brackets 52**.

In FIGS. 8 and 9 it may be seen that when the seat 56 is lowered, the bottom of the seat contacts the lever 55 and causes the silencer device 44 to swing the arm 45 and baffle 46 into the retracted or inoperative position at the rear of the toilet bowl 53. On the other hand when the seat 56 is raised as shown in FIG. 10, then a spring member 62 which is connected to the mounting member 51 and the arm member 45, biases the arm member 45, thereby causing the arm 45 and baffle 46 to swing into the extended or operative position in the bowl 53. While a flat spring has been used to illustrate the spring 62, it may be readily seen that a coil spring or other bias means may also be used.

The basic operating principle of the three embodiments of the invention are essentially the same and only the means of attaching the device to the toilet differs depending upon what type of seat hing arrangement is used on the particular toilet on which the device is to be mounted. The embodiment shown in FIGS. 8 through 11 can, of course, be used on any conventional seat hinge arrangement.

It should be recognized that variations in the materials used and in the means of attaching the device to the toilet can be resorted to and that these and various other modifications can be resorted to without departing from the scope of the invention.

I claim:

1. A toilet anti-splash and silencer device for use on a flush toilet including an assembly of a bowl with an upper rim and a seat hingedly mounted on seat hinge brackets attached adjacent the rim at the rear of the bowl comprising:

(A) means attaching the silencer device to the bowl and seat assembly at the seat hinge brackets for pivotal movement about an axis adjacent the upper rim at the rear of the bowl, said means comprising a thin flat member which is clamped under the seat hinge brackets when the device is in the assembled position on the toilet;

(B) an arm member pivotally attached to and extending from the attaching means into the interior of the bowl;

(C) a perforate baffle means fixedly attached to the end of the arm member which is extended into the bowl, at a location spaced from the interior wall of the bowl; and (D) a seat contacting means fixedly attached to the arm member at the end opposite the baffle means;

(E) said seat contacting means adapted to co-operate with the seat in such manner that when the seat is lowered, the seat bears downwardly against the seat contacting means, and moves the arm and baffle means to a retracted position at the rear of the bowl and when the seat is raised, it breaks contact with the seat contacting means, thereby permitting the arm and baffle means to move to an extended position toward the center of the bowl.

2. The device claimed in claim 1 wherein the baffle means is at least one screen member.

3. The device claimed in claim 1 wherein at least part of the device is made of molded plastic.

4. The device claimed in claim 1 wherein the seat contacting means is an upwardly and forwardly extending lever arm attached to a tubular hub member which carries the arm member supporting the baffle means.

5. The device claimed in claim 1 wherein a bias means is connected to the means attaching the silencer to the bowl and to the arm member supporting the baffle means to urge the arm member and the baffle means to move to the forward or extended position in the bowl when the toilet seat is raised.

6. The device claimed in claim 5 wherein the bias means is a spring member.

* * * * *